United States Patent [19]

Foster

[11] Patent Number: 4,911,443

[45] Date of Patent: Mar. 27, 1990

[54] FOOTBALL GAME SYSTEM AND METHOD OF PLAY

[76] Inventor: James F. Foster, 3614 Walters Ave., Northbrook, Ill. 60062

[21] Appl. No.: 103,426

[22] Filed: Sep. 30, 1987

Related U.S. Application Data

[63] Continuation-in-part of Ser. No. 805,118, Dec. 4, 1985, abandoned.

[51] Int. Cl.[4] ..... A63B 67/00

[52] U.S. Cl. ..... 273/55 D; 273/55 R; 273/410; 273/411

[58] Field of Search ..... 273/55 R, 55 D, 410, 273/411, 30, 407

[56] References Cited

U.S. PATENT DOCUMENTS

| | | | |
|---|---|---|---|
| 648,512 | 5/1900 | Manley | 273/55 D |
| 713,275 | 11/1902 | Atkins | 273/30 |
| 814,674 | 3/1906 | Conkling | 273/411 |
| 2,845,269 | 7/1958 | Simmons | 273/55 D |
| 3,586,326 | 6/1971 | McKenna | 273/55 D |
| 3,782,724 | 1/1974 | Rottman et al. | 273/55 D |
| 4,285,519 | 8/1981 | Donato | 273/30 |
| 4,625,974 | 12/1986 | Andrews | 273/407 |
| 4,723,780 | 2/1988 | Vinzetta | 273/407 |

*Primary Examiner*—T. Brown

*Attorney, Agent, or Firm*—Niro, Scavone, Haller & Niro, Ltd.

[57] ABSTRACT

A new game is disclosed, involving substantially the same rules as American football (e.g., NFL or NCAA) except that kicks or passes into the end zone may be deflected back onto the playing field as a playable ball by a rebounding assembly that surrounds the goalposts. Upon an attempted field goal, an errant kick will result in the ball hitting the rebounding assembly instead of passing between the vertical uprights of the goalpost. The reflected ball can be caught before it hits the ground by only players of the team defending the goal. Once caught, the defending team may advance the ball toward the opposite goal in accordance with the normal rules of American football. If the ball reflected off of the rebounding assembly hits the ground before it is caught by a player of the team defending the goal, the ball is free for players of either team to advance. In order to ensure that an errant kick results in the rebounding of the ball back into the playing field, the rebounding assembly is comprised of resilient material that returns much of the kinetic energy to the ball after it impacts the rebounding assembly. The rebound assembly for playing the game is comprised of a goal post substantially similar to that used in American football, with the exception that the instant goal is provided with a ball rebound net extending outwards from each side of the goal post, along the extremity of the end zone to substantially the entire width of the playing filed.

24 Claims, 2 Drawing Sheets

FOOTBALL GAME SYSTEM AND METHOD OF PLAY

This is a continuation-in-part application of co-pending U.S. patent application Ser. No. 805,118, filed Dec. 4, 1985 (abandoned).

BACKGROUND OF THE INVENTION

The invention relates to an apparatus and method for playing a game and more particularly to a new game incorporating many aspects of traditional American football.

As America's favorite spectator sport, the game of football has remained essentially unchanged over the years, excepting some minor changes in rules and player equipment. For example, the basic playing field, goalposts and ball have remained virtually the same over the years. The total length of the field between goal lines has remained at 100 yards, and the width of the field has stayed at approximately 50 yards. An end zone extends beyond each of the goal lines, having a depth of approximately 10 yards.

In each end zone, a field goalpost is positioned comprising two upright posts traversed by a horizontal crossbar that holds the two upright posts at an approximately 18-foot separation. The crossbar of the goalpost is held at a height of approximately 10 feet above the playing field by a support bar or bars that are mounted into the ground of the end zone. In the National Football League, the goalpost is held above the end zone by the support bars such that a plane containing the uprights and crossbar of the goalpost cuts through a back or end line of the end zone. Under NCAA rules, the goalpost in college play is moved forward so that the plane of the goalpost is over the goal line. A team may score points kicking a football through the space between the uprights of the goalpost and above its crossbar. If the football misses this space defined by the uprights and crossbar of the goalpost, the game is temporarily stopped and the ball is re-spotted on the field in accordance with the appropriate rules (e.g., NFL or NCAA).

SUMMARY OF THE INVENTION

It is the primary object of the invention to provide a variation of traditional American football that demands virtually all of the athletic skills of traditional football, but which is faster paced and may be played inside existing sports facilities.

It is another object of the invention to provide a game that can be safely played with spectators seated in close proximity to the playing field.

It is still another object of the invention to provide sufficient precautions to protect the players from indoor hazards resulting from a relatively small playing field, yet not mitigate the hard-contact and fast-paced action of traditional American football.

In accordance with the present invention, a new game involving the advancement of a ball across a playing field and over an opponent's goal line has substantially the same rules as American football (e.g., NFL or NCAA) except that kicks or passes into the end zone may be deflected back onto the playing field as a "live" ball by a rebounding assembly that is proximate to the goal line, but elevated above the playing field. Preferably, the rebounding assembly extends in a plane normal to the playing field and parallel to the goal line and includes a centrally located opening defining a scoring area. Upon an attempted field goal—executed by either placement of the ball as in American football or a drop-kick—an errant kick will cause the ball to hit the rebounding assembly instead of passing through the scoring area. Off the rebound and before the ball hits the playing field, the players of the team defending the goal associated with the rebounding assembly have a right to receive the ball. Once the ball has hit the playing field, it is free to be picked up and advanced by a player from either team. Forward passes that hit the rebounding assembly are live until the ball hits the ground.

In order to better assure that a ball kicked into the rebounding assembly is typically returned to the playing field, the assembly is comprised of resilient material that after absorbing the kinetic energy of ball, returns a significant portion of it to reflecting the ball off the rebounding assembly. Although the material comprising the rebounding assembly returns much of the kinetic energy to the ball, it also is sufficiently elastic so that the ball usually has a return trajectory that may be anticipated. More specifically, the preferred shape of the ball is that of the commonly known American football which is an oblong spheriod, and such a shape is conducive to erratic returns off the rebounding assembly. The elastic character of the rebounding assembly tends to negate the unpredictable effects of the oblong shape of the ball.

BRIEF DESCRIPTION OF THE DRAWING

The features of the invention believed to be novel are set forth with particularity in the appended claims. The invention itself, however, both as to its organization and methodology, together with further objects and advantages thereof, may best be understood by reference to the following description taken in conjunction with the accompanying drawings in which:

While the invention will be described in some detail with reference to a preferred embodiment, it is to be understood that it is not intended to limit the invention to such detail. On the contrary, it is intended to cover all alternatives, modifications and equivalents which fall within the sphere and scope of the invention as defined by the appended claims.

DETAILED DESCRIPTION OF THE PREFERRED EMBODIMENT

Figure 1:
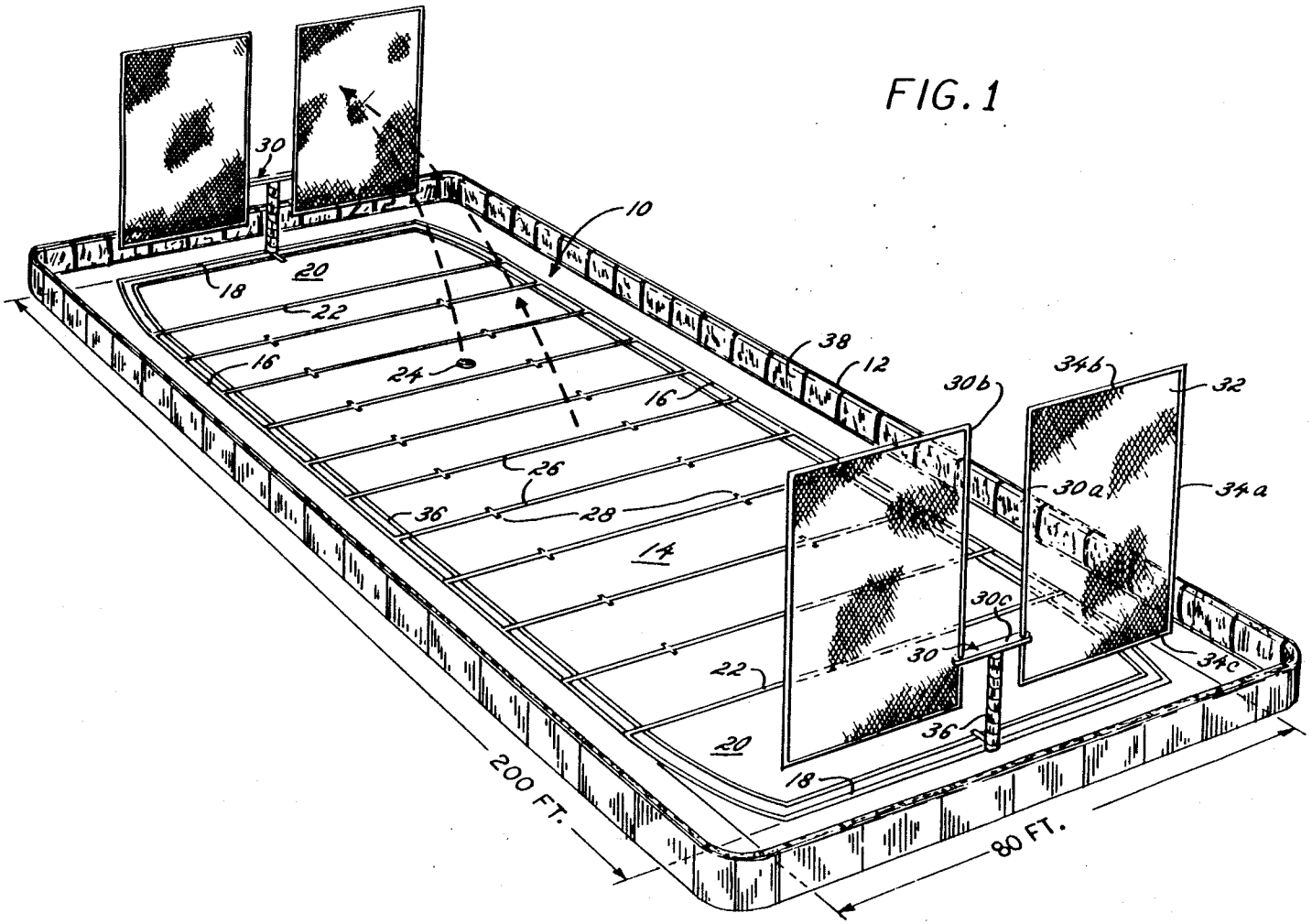
FIG. 1 is a perspective view of the playing field, goalposts and rebounding assemblies according to the invention.

Turning to the drawings and referring first to FIG. 1, a playing field 10 for the game of the present invention preferably has a total length of approximately 200 feet (60.96 meters) and a total width of approximately 85 feet (25.91 meters). Because the playing field is typically located inside a standard-sized arena, the field is typically circumscribed by a wall 12, separating the field from the surrounding spectator area. The playing field 10 is covered by a synthetic turf or padding similar to that found in many stadiums used for traditional American football. By providing a playing field 10 of approximately 200 feet by 85 feet, the game may be played in an indoor facility which includes a hockey rink of regulation size as defined by the National Hockey League (i.e., 200 feet by 85 feet).

Within the playing field 10, two pairs of opposing out-of-bounds lines define a generally rectangular-shaped playing area 14, having the approximate dimension of 200 feet by 80 feet. One of the pair of out-of-bounds lines includes parallel sidelines 16 which are preferably between two and five feet from the adjacent portion of the wall 12 surrounding the playing field 10. The other pair of out-of-bounds lines includes parallel end lines 18 that connect the two sidelines 10 and form a right angle at each junction. At either end of the regulation field is an end zone 20 defined by the area between the end line and a goal line 22. Each goal line 22 is parallel to the associated end line 18 and runs the width of the regulation field at a location of approximately 25 yards upfield from the end line.

As in traditional American football, one of two opposing teams attempts to move a ball 24 along the length of the field 10 and over one of the goal lines 22 while the other team opposes the movement. In order to move the ball 24 upfield, the game comprises a plurality of "plays", similar to the plays of American football. Specifically, a play is set up by first placing the ball 24 on the field 10 in accordance with the rules as explained hereafter. The ball 24 is placed so that its tip (the ball is approximately the shape of an oblong spheroid) is pointed upfield and tangent to a line traversing the width of the field and parallel to the goal lines 22 (i.e., perpendicular to the sidelines 16).

Both under the rules of the instant game and the rules of American football, the line that is tangent to the tip of the ball is called the line of scrimmage. Each team lines up on opposing sides of the line of scrimmage. Upon movement of the ball 24 by the team in possession of it, players may cross the line of scrimmage to either advance the ball upfield or tackle the player with the ball. A play ends when the player with the ball 24 is tackled, runs out of bounds (past the sidelines 16) or crosses the upfield goal line 22. A team loses possession of the ball 24 if it does not advance the ball more than a predetermined distance in four successive plays. Preferably, the predetermined distance is 10 yards as in American football.

In order to provide for accurate relative placement of the ball, the regulation field is divided by a plurality of placement-marking lines 26 that visualize the lines of scrimmage at equal incremental distances from one end zone to the other. Each marking line 26 is preferably a strip of approximately five to six inches in width that extends from one sideline 16 to the other. As illustrated, the playing field 10 is marked in five-yard increments.

Each marking line 26 includes hash marks 28 for placement of the ball 24 relative to the sidelines 16. These hash marks 28 are similar to those used in traditional football. Each of these hash marks 28 is approximately 12 inches long and is placed so that its longitudinal axis is parallel to the sideline 16. Preferably, each marking line 26 includes a pair of hash marks 28 with each mark placed a predetermined distance from the nearest sideline 16.

Located above each end line 18 of the regulation field is a goalpost 30 comprising two parallel and vertical bars **30*a*, 30*b* separated by a nine-foot long horizontal crossbar 30*c*. The vertical bars 30*a*, 30*b* extend approximately 40 feet high above the playing field. The area above the crossbar 30*c* and between the two vertical bars 30*a*, 30*b* defines a scoring area. By kicking a ball 24 through the scoring area, a team may score points. Each goalpost 30 is elevated above the associated end line 18 such that the crossbar 30*c* is 15 feet above the playing field 10. The goalpost 30 is located along the length of the end line 18** such that the scoring area is centrally located above the line.

Figure 3:
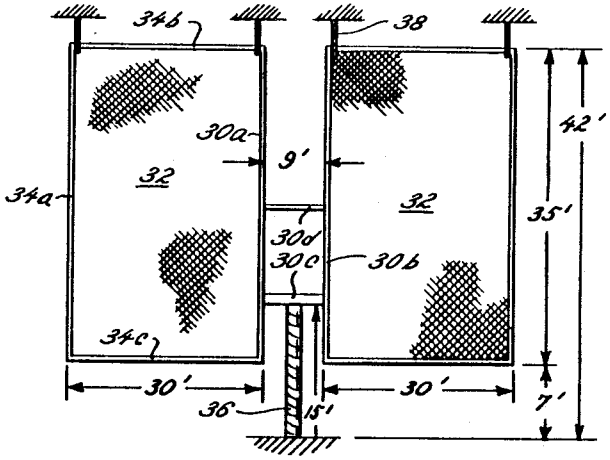
FIG. 3 is a front view of the left and right panels of the rebounding assemblies mounted on either side of an associated goalpost, where the goalposts are according to an alternative embodiment.

In an alternate embodiment, a second horizontal crossbar **30*d* joining the vertical bars 30*a*, 30*b* as illustrated in FIG. 3 is positioned above the first horizontal bar 30*c*. Unlike the first embodiment where the scoring area extends infinitely upward from the first crossbar 30*c*, the addition of the second crossbar 30*d* places a boundary on the upward extent of the scoring area. By limiting the extent of the scoring area above the first crossbar 30*c*, additional accuracy is required to kick the ball 24** through the smaller scoring area, thereby requiring additional skill to score points.

In accordance with one important aspect of the invention, a new game involving the advancement of the ball 24 across the playing field 10 and over an opponent's goal line 22 has substantially the same rules as American football except that kicks or passes into the end zone 20 may be deflected back onto the playing field as a "live" ball by rebounding the ball off of a rebounding assembly associated with each goalpost 30. Preferably, two opposing teams, each having eight players, attempt to move the ball in a manner to score points in accordance with the rules of the game. The most points are scored when a team is able to move the ball either by running or passing it to the end zone 20 protected by the opposing team. A lesser number of points may be scored if a team successfully kicks the ball from any position on the playing field 10 through the scoring area of the goalpost 30. An errant kick causes the ball 24 to be reflected off the rebounding assembly positioned on either side of the scoring area. As the ball 24 returns into the playing area 10 from the rebounding assembly, it is considered a "live" ball that may be caught by the opposing team and advanced toward the opposite end zone 20. Until the reflected ball 24 touches the playing field 10, the players of the team opposing the kick attempt are entitled to catch the ball without interference from the kicking team. Preferably, players of the kicking team are required to remain beyond the perimeter of a circle surrounding the receiving player. Preferably, the circle has a radius of five feet.

In keeping with the invention, the rebounding assembly is constructed of material that returns to the ball 24 a significant portion of its incident kinetic energy. By returning a significant amount of the kinetic energy to the ball 24 as it reflects off the rebounding assembly, the ball will usually return to the playing area 14 of the field 10, thereby enhancing the pace of the game by ensuring an errant kick provides the defending team with an opportunity to advance the ball toward the opposite goal line 22. To accomplish this desired reflection of the ball 24, the rebounding assembly is preferably comprised of resilient material that will not permanently deform from the impact of a kicked or thrown ball. In order to reduce the degree of erratic behavior of the reflected ball 24 caused by its non-spheroidal shape, the rebounding assembly is preferably elastic so that the trajectory of the reflected ball is somewhat predictable as suggested by the trajectory illustrated in FIG. 1. By providing an elastic material for the rebounding assembly, an incident ball 24 touches the assembly over a larger area than if the rebounding material is non-elastic. By distributing the transfer of energy back to the ball 24 over as large an area of the ball as possible, the erratic behavior of the ball caused by its non-spheroidal shape is minimized.

Preferably, the rebounding assembly comprises a pair of nets made of loosely woven cords such as hemp cords or elastomeric fibers having good elongation and recovery properties. Examples of suitable fiber material are natural rubber or urethane polymers generically referred to as "spandex." The cords or fibers are preferably loosely woven to form a semitransparent web. More specifically, the net is a web whose mesh is sufficiently open to allow spectator viewing from seats behind the net, yet closed enough to ensure the ball will not pass through or catch in the net. In this regard, a closed-weave net made of canvas may be substituted for the web of elastomeric fibers to provide a less expensive rebounding assembly. However, canvas has the undesirable property of opacity.

Alternatively, the rebounding assembly may be comprised of film or sheeting material that has good elongation or elastomeric qualities and a high degree of transparency. Examples of possible material are commercially available forms of fluoroplastics, polyethylene ethylene copolymers (vinyl acetate and methyl acrylate), polypropylene and plasticized vinyl film. Less preferred because of its opaque characteristic are foams such as a polyurethane elastomer. Yet another alternative for the rebounding assembly is a hard sheet or film material. For example, a transparent unplasticized vinyl film or sheet would provide a durable surface, but its elastic qualities are inferior to other materials and therefore would be characterized by more erratic rebounds.

Returning to the preferred embodiment, the pair of rebounding nets 32 in FIGS. 1 and 3 extends laterally from the vertical bars 30*a*, 30*b* on each side of the scoring area. The rebounding nets 32 are each supported on frames that stretch the nets taut so that they provide resilient surfaces, off of which missed kicks may rebound. Each frame incorporates one of the vertical bars 30*a*, 30*b* of the goalposts and adds an additional vertical bar 34*a* separated by upper and lower horizontal bars 34*b*, 34*c*, respectively, that together define a rectangular area over which the rebounding nets are placed. The assembly of the two nets joined by the horizontal crossbar 30*c* are suspended over the playing field by a support posts 36 joining the crossbar 30*c* to the playing field 10. Alternatively, or additionally, support cabling 38 suspended from the ceiling of the arena may be attached to the top horizontal bar 34*b* of the frames. In the illustrated embodiment, the height of each rebounding net 32 from its base at the playing surface to the top is approximately 42-feet high by 30-feet wide.

Figure 4:
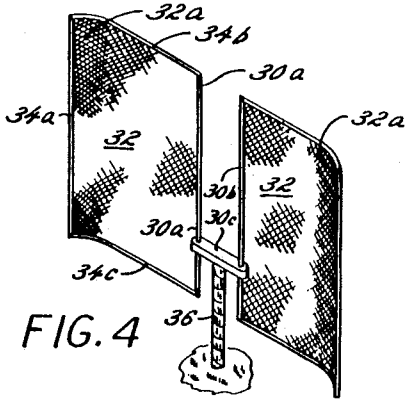
FIG. 4 is a perspective view of the rebounding assembly, illustrating an alternative embodiment wherein the panels curve at their lateral periphery.

An alternative embodiment of the goalpost apparatus is shown in FIG. 4, where each of the rebounding nets 32 has a lateral periphery 32*a* furthest away from the scoring area that is curved inwardly toward the playing field 10. By inwardly curving the lateral periphery 32*a* of each net 32 towards the playing field, errant balls that hit the periphery are more likely to be reflected back into an inbounds area of the playing field 10. Preferably, the curve of the lateral periphery 32*a* of each of the rebounding nets 32 extends such that the end of the net is approximately parallel to the length of the playing field 10.

In connection with the alternative embodiment shown in FIG. 3 wherein a second crossbar 30*d* is added, a third net panel (not shown) may be added to the rebounding assembly in the area between the two nets 32 and above the second crossbar. As a result of the addition of a third net, balls kicked over the crossbar 30*d* would not only not score points, but also will rebound the ball.

Figure 5:
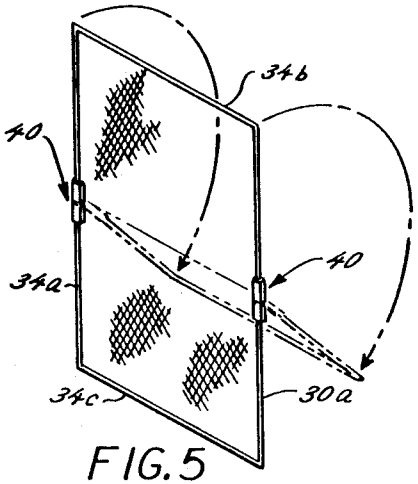
FIG. 5 is a perspective view of one of the panels of the rebounding assembly of FIG. 3, including a pair of hinges incorporated into the frame of the panel for folding.
Figure 6:
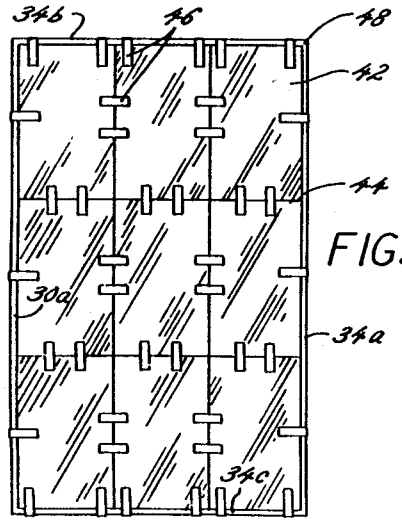
FIG. 6 is a rear view of another alternative embodiment for one of the panels of the rebounding assembly, wherein the panel incorporates a plurality of transparent and resilient sheets that are detachably interlocked for easy disassembly and transporting.

In order that the rebounding assembly be transportable, the frame may be hinged as illustrated in FIG. 5. If a transparent sheet is substituted for the preferred net, it may be formed from a plurality of interlocked sections as illustrated in FIG. 6. Referring more specifically to the hinged frame of FIG. 5, conventional hinge apparatus 40 are incorporated into the vertical bar 30*a* of the goalpost 30 and the opposite vertical bar 34*a*. As suggested by the position of the upper part of the net shown in phantom line in FIG. 5, the frame may be folded in half about an axis refined by a straight line passing through both hinge assemblies 40. Of course, additional pairs of complementary hinge assemblies may be added if the net is required to be folded to a smaller dimension than the dimension of the net when folded in half. Each section 42 of the transparent sheet illustrated in FIG. 6 is secured to adjacent portions of the frame 44 or to adjacent sections. Conventional coupling devices 46 interlock the sections 42 and secure the composite transparent sheet to the frame. By removing the coupling devices 46, the sections 42 may be stacked for transportation or storage. The vertical and horizontal bars 30*a*, 34*a*, 34*b*, 34*c* of the frame 44 can be detached at their joints 48.

Figure 2:
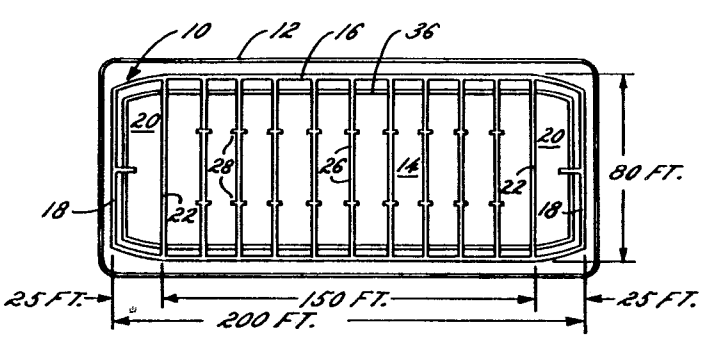
FIG. 2 is a plan view of the playing field of FIG. 1.

Because the sidelines 16 and end lines 18 of the playing field 10 are relatively close to portions of the wall 12 and such proximity represents a player hazard, the playing field is preferably marked about its periphery with a warning line 36. The warning lines 36 illustrated in FIGS. 1 and 2 are 10–20 inches wide, brightly colored and placed five feet in from the sidelines 16 and end lines 18.

To further protect players from injury, the wall 12 is covered by a protective cushioning 38 that may be commercially available foam padding similar to the padding used around the support bar for goalposts in traditional football. Preferably, the cushioning material is at least ten-inches thick. Particular arenas may have other obstacles requiring padding such as seats, posts or partitions. Of course, the support bars 36 for the goalposts 30 should be padded. The football 24 is approximately the same dimensions as an NFL football, but preferably weighs slightly more due to the shorter throwing distances involved. Players will wear standard regulation professional football equipment, although provisions may be made for minor modifications.

The recognized rules of American football (e.g., NFL or NCAA) can be used, except for the afore-mentioned allowances made for the use of the rebounding assembly. In the preferred embodiment, however, for indoor football play, each team has only eight players on the playing field at any given time during regulation play. In contrast to this, standard NFL or NCAA football rules require eleven players on the field per team. Preferably, the offensive line of each team is comprised of four offensive players at the line of scrimmage at the start of each play, other than for kickoffs. The interior three players on the line of scrimmage are not eligible to receive a forward pass. Furthermore, the size of the playing field is preferably less than the regulation size of NFL or NCAA football in order to accommodate playing of the game indoors. Specifically, the field is preferably less than 120 yards long and less than 160 feet wide.

All but one running back and receiver have the option of going in motion behind the line scrimmage prior to the snap of the football and after the offensive team has gone into a set over the football 24 at the line of scrimmage. This does not include the quarterback. The quarterback may only drop backward from the line of scrimmage prior to the snap.

In the preferred embodiment, the teams use a single platoon system, where all players must play both offense and defense from the duration of the game. Substitution of players is controlled in that a player must play both offensive and defensive series before being replaced, unless injured for the duration of that half of play. An exception of this rule will be to allow each team to designate one player as a one-way player, such as a quarterback. Also, the kicker will not be required to play another position and will not be counted as a designated one-way player.

Kick-offs will be used to start each game after the coin toss to decide possession, and kick-offs will be used to start the second half and first overtime periods if needed. Kick-off is also used to resume play after each touchdown and extra point attempt. Field goals will be utilized in either the indoor or outdoor format. In the indoor format and in the preferred embodiment, there is no punting of the ball due to the height and distance restrictions in indoor facilities. In the indoor format, the team can elect to attempt a field goal on any down from any point on the field.

For scoring successful field goals, a successful field goal from a placement kick is tallied as three points, except for successful drop kick field goals which will be worth four points. Also, as in traditional football, after a team scores a touchdown (worth six points), it may attempt a kick to add an extra point if kicked by placement or an extra two points if drop kicked. The defensive team can return any field goal attempt which is not successful and is rebounded off the rebounding nets, by returning the ball from where it is recovered by the defensive team, anywhere on the field of play.

In summary, an exciting new variation of traditional American football is provided for both outdoor and indoor formats. The essential rules may be summarized as follows:

PLAYERS

Eight players on offense and eight players on defense.

Total roster of 16 players with reserve players available if needed.

Five offensive players must be lined up at the line of scrimmage.

A minimum of three defensive players must be lined up at the line of scrimmage.

Players will play both offense and defense (single platoon) with the exception of the kicker and two other squad members who are not required to play both offense and defense.

Substitution—a player who leaves the game before playing 5 minutes of offense and defense series must sit out for five minutes of game time before reentering the game. This rule may be waived by the head official for legitimate injuries or equipment problems. Quarterbacks are exempt from this rule.

TIME OF PLAY

Four 15-minute quarters with a 15-minute halftime. The time between plays must not exceed 30 seconds.

The game clock will not stop for out-Of-bounds plays or incomplete passes except in the last minute of the first and second half. The clock will stop only as long as the referee deems necessary for penalties and injuries. The clock will stop for television timeouts. Each team will be allowed three timeouts per half.

MOVEMENT OF BALL AND SCORING

Four downs allowed to move the ball ten yards for a first down.

Six points for a touchdown.

One point for a conversion by place kick after touchdown.

Two points for a conversion by drop kick after touchdown.

Two points for a conversion by successful run or pass after touchdown.

One point for a missed conversion kick that is caught off the rebound nets in the end zone or advanced into the end zone by a player on the kicking team.

Three points for field goal by placement.

Four points for field goal by drop kick.

Two points for a safety.

OFFENSIVE MOTION

Two players on the offensive team other than down lineman will be eligible to be in motion parallel to the line of scrimmage. Forward motion is allowable by one of the two players.

KICKOFFS

Kickoffs are used to begin the game and the second half and after successful touchdowns and field goals.

Kickoffs are from the goal line with a 1" kicking tee.

Punting is illegal.

Field goal attempts by placement or drop kick replace punts.

A kick that travels out of bounds is spotted by the official at the point where it traveled out and then a five-yard penalty is assessed against the kicking team before the next play from scrimmage.

USE OF GOALSIDE REBOUND NETS

Unsuccessful field goal attempts that rebound off the nets flanking the goalposts can be fielded and returned. Only kicks caught in the end zones may be downed (touchback) and are then placed on the five-yard line.

The receiving team on a kickoff or field goal attempt has first right to field the football but may not call for a fair catch or down the ball other than in the end zone. The kicking team must give the receiver a five-yard parameter to field the ball. If not fielded, it becomes a live ball and is able to be advanced once it touches the playing surface.

The same rules apply for kickoffs and field goal attempts that do not travel far enough to rebound off the nets.

On extra point kick attempts after a touchdown that rebounds off the nets, an offensive player who either catches the ball in the end zone, or catches it and advances it into the end zone will be awarded a single point for his team.

PASSING

Passing rules are the same as in traditional American football with one exception. A forward pass that rebounds off the nets within the field of play is a live ball and is playable until it touches the playing surface.

A pass receiver must have one foot in bounds on a reception.

An offensive player running a pass route who is forced ut of bounds by a defender can return to the field of play and be eligible to legally catch a pass.

What is claimed is:

1. A method of playing a game comprising the steps of:

(a) providing a playing field having a first end line and a second, opposing end line;

(b) providing a ball having the general shape of an oblong spheroid similar to that of an American football;

(c) providing a goal in association with each of said end lines such that said goal defines a scoring area elevated above said playing field;

(d) providing a first team of players having as an objective to move said ball across said first end line wherein movement of said ball is accomplished by a player optionally 1) running with said ball, 2) passing said ball to another player, or 3) kicking said ball through said scoring area;

(e) providing a second team of players having as an objective to defend said first end line by stopping the movement of said ball by said first team toward said first end line, whereby said movement may be stopped by players of said second team by either optionally 1) tackling a player of said first team who is carrying said ball, 2) disrupting a pass from one player of said first team to another, or 3) disrupting an attempt by said first team to kick said ball through said scoring area;

(f) providing said first team with a predetermined number of successive plays to move said ball a predetermined distance wherein each play may be ended when said second team either 1) tackles a player of said first team who is carrying said ball, 2) disrupts a pass from one player of said first team to another, or 3) disrupts an attempt by said first team to kick said ball through said scoring area; and (g) providing surface means adjacent said goal and above said playing field for deflecting at least one of errant kicks and passes aimed toward said scoring area back toward said playing field where players from said second team are free to catch said ball off said deflecting surface means and before it touches the playing field without interference by players of said first team.

2. A method of playing a game as set forth in claim 1 including the steps of allowing a pass between players to intermittently include a rebound of the ball off said deflecting surface means.

3. A method of playing a game as set forth in claim 1 including the step of providing a padded barrier around the perimeter of said playing field.

4. A method of playing a game as set forth in claim 1 wherein said ball may be kicked either by placement of said ball on the playing field or by dropkicking it.

5. A method as set forth in claim 1 wherein said goal defines a scoring area that is generally U-shaped.

6. A method as set forth in claim 5 wherein said goal comprises a pair of vertical bars joined by a crossbar.

7. A method as set forth in claim 6 wherein said deflecting surface means comprises a resilient material extending from each of said vertical bars in opposite directions forming a rebounding surface.

8. A method of playing a game with a ball, said game comprising the steps of:

(a) providing a generally rectangular-shaped playing field having a length dimension of less than 120 yards and a width dimension of less than 160 feet;

(b) providing a pair of opposing goals, each associated with one of the ends of the rectangular-shaped playing field such that each goal defines a scoring area elevated above said playing field;

(c) providing first and second teams of players, each team alternatively having possession of said ball and having as an objective to score points by kicking said ball through said scoring area; and (d) providing surface means adjacent each of said goals and above said playing field for deflecting errant kicks aimed at said scoring area back towards said playing field where players from the non-kicking team are free to catch said ball off said deflecting surface means and before it touches the playing field without interference by players of the kicking team.

9. A method of playing a game as set forth in claim 8 wherein in addition to kicking said ball through said scoring area, a player from the team in possession may also score points by optionally 1) running with said ball over a goal line associated with each of said goalposts or 2) throwing said ball to another player of the same team who catches the ball beyond the goal line or runs over said goal line after catching said ball.

10. A method of playing a game as set forth in claim 9 wherein the team not in possession of the ball has as an objective to defend one of said goals by stopping the movement of said ball by said team in possession, whereby said movement may be stopped by players of said non-possession team by either optionally 1) tackling a player of said team in possession who is carrying said ball, 2) disrupting a throw of the ball from one player of said team in possession to another, or 3) disrupting an attempt by said team in possession to kick said ball through said scoring area.

11. A method of playing a game as set forth in claim 10 wherein said team in possession is provided with a predetermined number of successive plays to move said ball a predetermined distance wherein each play may be ended when said team not in possession either 1) tackles a player of said team in possession who is carrying said ball, 2) disrupts a throw of the ball from one player of said team in possession to another, or 3) disrupts an attempt by said team in possession to kick said ball through said scoring area.

12. In a game system substantially similar to American football and including a playing field defined by a surface of predetermined length and width have an end zone at each end of the playing field defined by a goal line and a goalpost disposed at the extremity of each end zone, said goalpost comprising:

a U-shaped scoring area positioned above and spaced from the playing field surface;

said U-shaped scoring area being parallel to and centered across the width of the playing surface;

rebounding means disposed on both sides of the scoring area and extending outwardly therefrom along substantially the entire width of said playing field; and said rebounding means being comprised of a resilient surface for rebounding an incident football and returning it towards said playing field when said football misses said scoring area.

13. The goalpost of claim 12 wherein the U-shaped scoring area is defined by a frame comprising two vertical bars joined by a horizontal bar.

14. The goalpost of claim 13 wherein said resilient surface is secured to said frame.

15. The goalpost of claim 14 wherein said resilient surface comprises a mesh webbing.

16. The goalpost of claim 12 wherein said resilient surface is a material substantially transparent so as to enable observation of the game from behind the associated end zone.

17. The goalpost of claim 12 wherein said resilient surface is a flexible sheet material.

18. The goalpost of claim 12 wherein said resilient surface is an elastic-formed material having a sufficient density and coefficient of elasticity so as to substantially prevent dissipating the kinetic energy of an impacting football thereby substantially reducing any deadening of the impacting football's rebounding.

19. The goalpost of claim 12 wherein said resilient surface is a high-strength woven material.

20. The goalpost of claim 12 wherein said rebounding means comprises a pair of rectangular and spaced-apart structures having supporting means maintaining said rebound means elevated above said playing field and a horizontal member joining said pair of rectangular structures as spaced relationship such that the space above said horizontal member defines said U-shaped scoring area.

21. The goalpost of claim 12 wherein said rebounding means includes means for collapsing said rebounding means so as to make it susceptible to transporting.

22. The goalpost of claim 17 wherein said sheet material is transparent.

23. The goalpost of claim 20 wherein each of said structures is planar and includes a resilient surface for rebounding an incident football.

24. The goalpost of claim 20 wherein each of said structures has a substantially planar surface except at one of its lateral peripheries where it curves inwardly toward an upfield position over said playing field in order to rebound errant footballs whose trajectory does not carry over an end line of said playing field.

* * * * *